US006564409B2

(12) United States Patent
Metz et al.

(10) Patent No.: US 6,564,409 B2
(45) Date of Patent: May 20, 2003

(54) BUMPER APPARATUS FOR A HOSPITAL BED

(75) Inventors: Darrell L. Metz, Batesville, IN (US); David W. Hensley, Milan, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/920,158

(22) Filed: Aug. 1, 2001

(65) Prior Publication Data

US 2002/0083526 A1 Jul. 4, 2002

Related U.S. Application Data

(60) Provisional application No. 60/222,418, filed on Aug. 1, 2000.

(51) Int. Cl.[7] ..... A47C 31/00

(52) U.S. Cl. ..... 5/663; 5/424; 5/430; 5/600; 5/658; 16/86 R; 16/82; 248/345.1

(58) Field of Search ..... 5/663, 430, 424, 5/658, 600, 624; 248/345.1; 16/82, 83, 85, 86 R, 86 B

(56) References Cited

U.S. PATENT DOCUMENTS

| | | | | |
|---|---|---|---|---|
| 1,017,153 A | * | 2/1912 | Kampe | 5/663 |
| 1,043,370 A | | 11/1912 | Stubbs | |
| 1,440,783 A | * | 1/1923 | Kiley | 248/345.1 |
| 4,016,613 A | * | 4/1977 | Benoit et al. | 5/663 |
| 4,062,075 A | * | 12/1977 | Stern et al. | 5/611 |
| 4,259,762 A | * | 4/1981 | Civitelli | 16/85 |
| 4,724,555 A | | 2/1988 | Poehner et al. | |
| 4,821,470 A | | 4/1989 | Kappers et al. | |
| 4,949,410 A | * | 8/1990 | Failor et al. | 5/425 |
| 5,060,425 A | | 10/1991 | Kappers et al. | |
| 5,117,521 A | | 6/1992 | Foster et al. | |
| 5,129,117 A | | 7/1992 | Celestina et al. | |
| 5,283,096 A | * | 2/1994 | Greenberg et al. | 24/297 |
| 5,323,565 A | | 6/1994 | Kappers et al. | |
| 5,527,097 A | * | 6/1996 | Martin | 297/463.1 |
| 5,611,094 A | * | 3/1997 | D'Entremont | 248/345.1 |
| 5,653,064 A | | 8/1997 | Kappers et al. | |
| 5,749,123 A | * | 5/1998 | Warren et al. | 16/83 |
| 5,802,636 A | | 9/1998 | Corbin et al. | |
| 5,878,452 A | | 3/1999 | Brooke et al. | |
| 6,178,576 B1 | * | 1/2001 | Newell | 248/345.1 |
| 6,185,767 B1 | | 2/2001 | Brooke et al. | |
| 6,212,714 B1 | | 4/2001 | Allen et al. | |
| 6,226,821 B1 | | 5/2001 | Heimbrock et al. | |
| 6,240,583 B1 | | 6/2001 | Brooke et al. | |
| 6,282,738 B1 | | 9/2001 | Heimbrock et al. | |
| 6,290,194 B1 | | 9/2001 | Chaconas et al. | |

FOREIGN PATENT DOCUMENTS

| | | |
|---|---|---|
| GB | 7095 | 3/1913 |

OTHER PUBLICATIONS

Hill–Rom User Manual, ZoneAir® Sleep Surface System, 8 pgs. (May 1, 1998).

Hill–Rom Brochure, "Manual Hi–Lo Bed", 2 pgs. (1998).

Hill–Rom Brochure, "Affinity® Three Birthing Bed", 2 pgs. (2000).

Brochure, "A Hill–Rom Solution—TOTALCARE® Bed System", 10 pp. (2000).

* cited by examiner

*Primary Examiner*—Robert J. Sandy
*Assistant Examiner*—Katherine Mitchell
(74) *Attorney, Agent, or Firm*—Bose McKinney & Evans LLP

(57) ABSTRACT

A bumper apparatus for a patient support including a body pivotally coupled to the patient support. A biasing mechanism is configured to align a longitudinal axis of the body in a generally horizontal position extending away from the patient support.

61 Claims, 8 Drawing Sheets

BUMPER APPARATUS FOR A HOSPITAL BED

CROSS-REFERENCE TO RELATED APPLICATION

This application claims the benefit of U.S. Provisional Application Serial No. 60/222,418, filed Aug. 1, 2000.

BACKGROUND OF THE INVENTION

The present invention relates generally to a bumper apparatus for a patient support or hospital bed. More particularly, the present invention relates to a bumper apparatus for a hospital bed which reduces the likelihood of damage to a wall, a bed locator, or equipment as a patient support platform of the bed moves between an elevated position and a lowered position.

A patient in a healthcare facility typically resides in a patient support, usually a bed, for a portion of his or her stay. In order to allow the patient to be easily moved about the healthcare facility, beds have been designed with wheels or casters. Many hospital beds have medical devices, electronic or otherwise, installed in them. These devices often require a power source to operate and, as such, the device and the bed housing the device are typically placed near a power source, usually housed in a wall. The wall often also has outlets for gasses, vacuums, monitors, and call buttons that may be of use to the patient, need to be accessible to the patient, or need to be attached to the patient. Therefore, it is often desirable or convenient to locate the bed as near to the wall as possible.

Once a bed is positioned in a room, it is often necessary to adjust the height of a support platform on which the patient is situated. For instance, the platform may be elevated for a particular examination or procedure and then lowered to facilitate the patient getting onto or off of the platform. In certain bed models, vertical movement of the support platform by a hi/lo or lifting mechanism is also accompanied by horizontal movement of the platform toward and away from the wall. If the bed is located too close to the wall, such horizontal movement due to a change in elevation of the platform may cause damage to the wall, the bed, or to medical equipment.

SUMMARY OF THE INVENTION

According to the present invention, a bumper apparatus for a patient support, or bed, includes an elongated body pivotably coupled to the bed, and a biasing mechanism coupled to the elongated body. The biasing mechanism is configured to align a longitudinal axis of the elongated body in a generally horizontal position extending away from the bed. The elongated body is configured to provide adequate spacing between the bed and the wall or other fixed items to reduce the likelihood of damage to the wall, bed locator, or equipment as a patient support platform of the bed is moved between an elevated position and a lowered position.

In the illustrated embodiment, the bed includes a base, a support platform configured to support a patient, and a lifting mechanism configured to move the support platform vertically relative to the base between a first or elevated position and a second or lowered position. The support platform also moves horizontally relative to the base by a predetermined horizontal distance as the platform moves between the elevated position and the lowered position. The body of the bumper apparatus is pivotably coupled to the support platform.

The illustrated body includes a nose surface configured to engage a wall. The body is configured to pivot in a first direction relative to the bed when the body is engaged with the wall and when the support platform of the bed is moved to the elevated position. The body pivots in a second direction relative to the bed when the body is engaged with the wall and when the support platform of the bed is moved to the lowered position.

In the illustrated embodiment, the body further includes a back surface positioned opposite the nose surface. The body is pivotably coupled to the support platform about a pivot axis which is closer to the back surface than the nose surface. In an illustrated embodiment, a distance from the nose surface to the pivot axis minus a distance from pivot axis to the back surface is greater than or equal to the predetermined horizontal distance of the support platform as the platform moves between the elevated position and the lowered position.

Additional features of the invention will become apparent to those skilled in the art upon consideration of the following detailed description when taken in conjunction with the accompanying drawings.

BRIEF DESCRIPTION OF THE DRAWINGS

The detailed description particularly refers to the accompanying drawings in which.

DETAILED DESCRIPTION OF THE DRAWINGS

Figure 1:
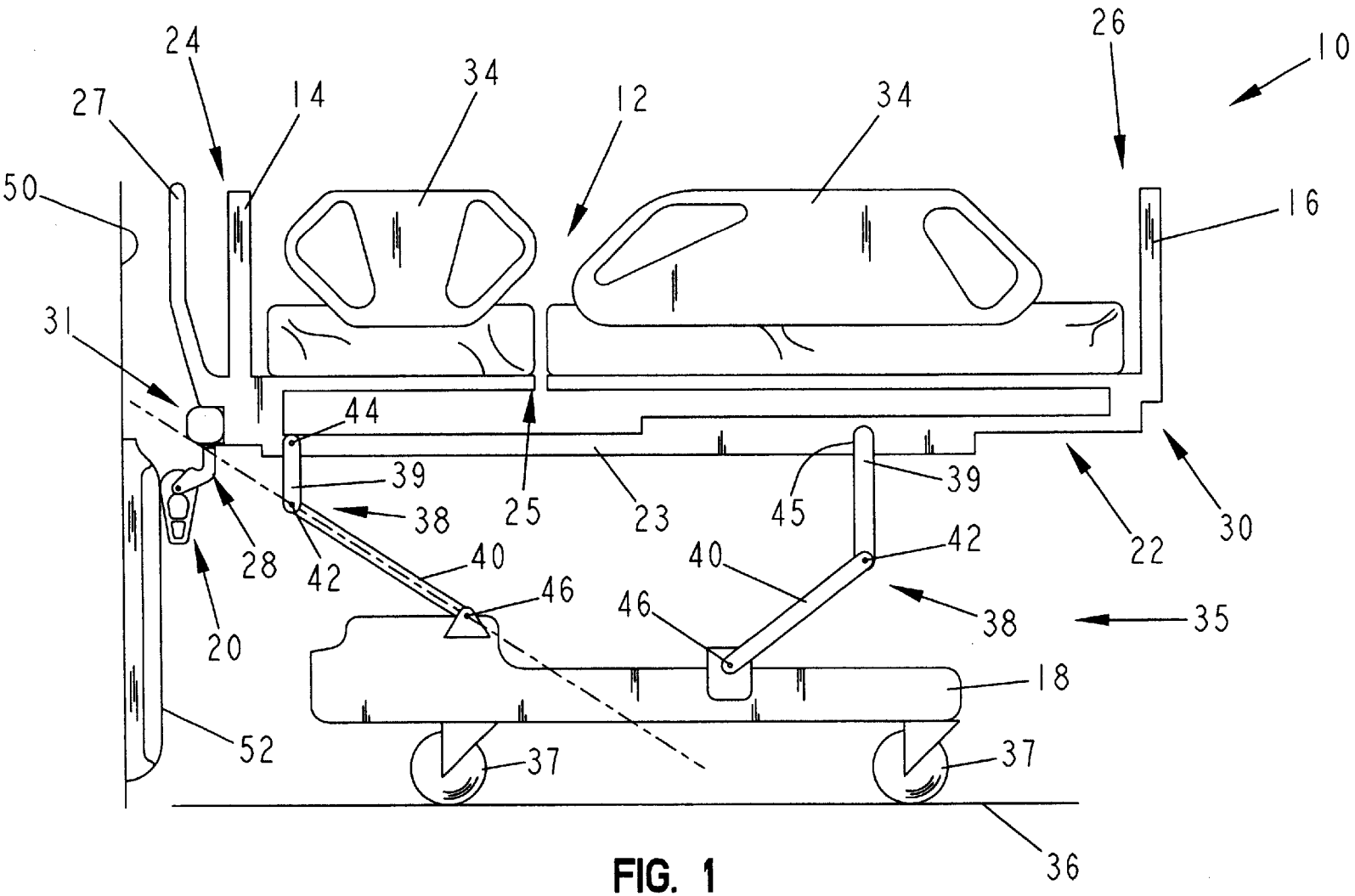
FIG. 1 is a side elevational view of a hospital bed illustrating a patient support platform in a raised or elevated "high" position and further illustrating a bumper apparatus of the present invention.

Referring now to the drawings, a patient support in the form of a hospital bed 10 includes a mattress 12, a headboard 14, a footboard 16, a base 18, and at least one horizontal spacing means or end bumper 20. The mattress 12 is situated on a support platform 22 which illustratively includes a frame 23 and a support deck 25 and which extends longitudinally between a head end 24 and a foot end 26. Typically, the deck 25 includes a plurality of articulating deck sections to permit the patient to be supported in a plurality of different positions in a conventional manner. See, for example, U.S. Pat. No. 5,715,548 which is assigned to the assignee of the present invention and is expressly incorporated by reference herein.

The headboard 14 is attached to the frame 23 at the head end 24 of the platform 22. The footboard 16 is attached to the frame 23 at the foot end 26 of platform 22. At least one push handle 27 is also illustratively coupled to the frame 23 proximate the head end 24 of the platform 22. First and second end bumpers 20 are illustratively coupled the frame 23 at the head end 24 of the platform 22 by brackets 28 and horizontal axles 29 on which the bumpers 20 pivot. The first and second end bumpers 20 are laterally spaced proximate opposite sides 30 of the platform 22. While only one of the end bumpers 20 is described below, it should be appreciated both end bumpers 20 are identical and operate in the same manner.

Figure 4:
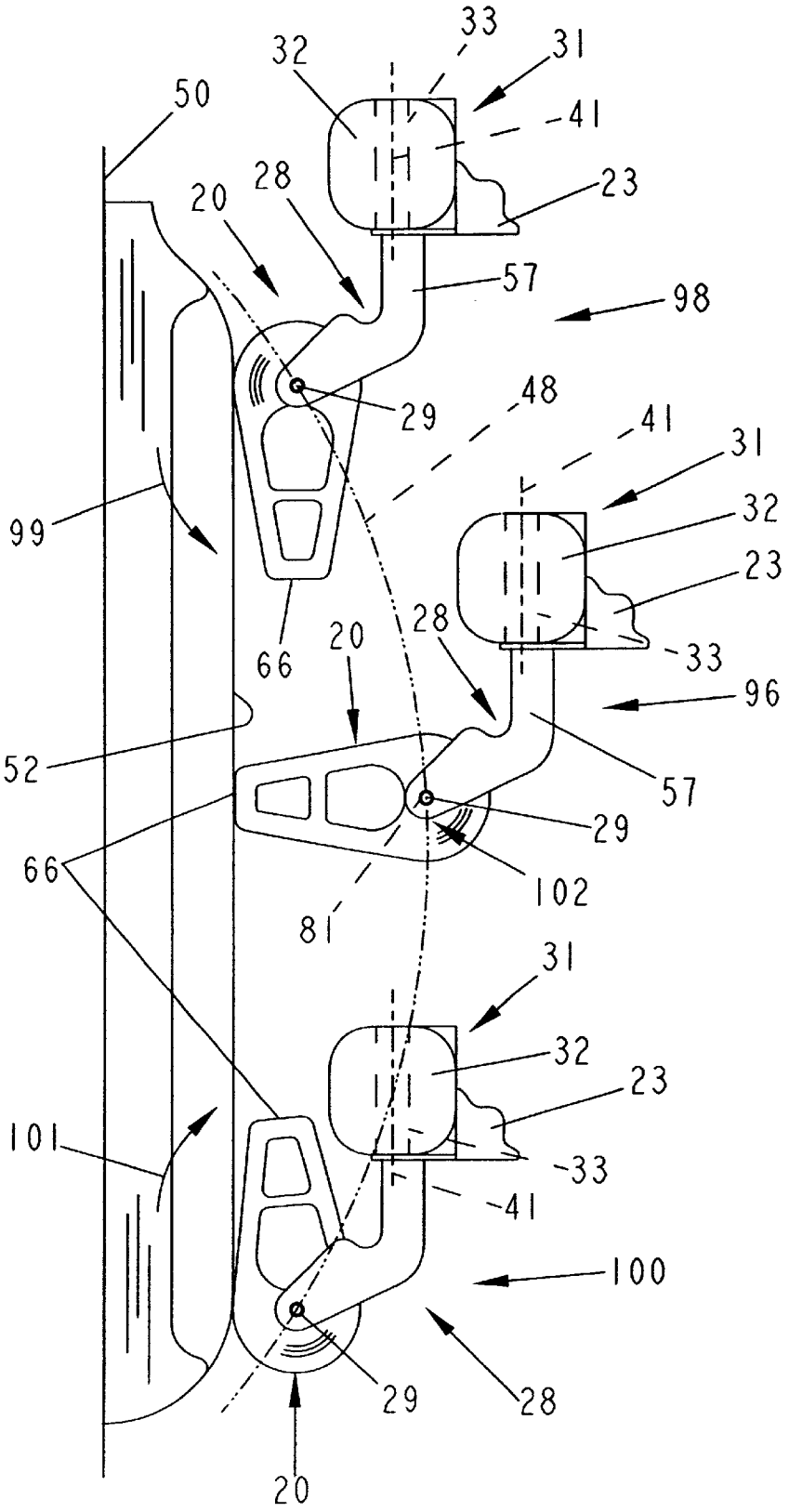
FIG. 4 is a side elevational view illustrating the path through which the bumper apparatus attached to a frame of the bed travels as the bed passes through the positions shown in FIGS. 1–3.

The bed 10 also includes two horizontally rotating circular side bumpers 31. The side bumpers 31 illustratively each include a roller 32 supported to rotate about a vertical axis 41 defined by a vertical axle 33 when acted upon by a horizontal force as best shown in FIG. 4. The side bumpers 31 are preferably located proximate opposing corners of the head end 24 of the platform 22. Again, while only one of the side bumpers 31 is illustrated, it should be appreciated that both side bumpers 31 are identical and operate in the same manner. The side bumpers 31 reduce the likelihood that the frame 23 will contact a wall 50 or attached object when the bed 10 approaches the wall 13 at an angle in which the headboard 14 is not parallel to the wall 50. Moreover, the rollers 32 provide for rolling contact with the wall 50 or attached object in order to reduce damage typically caused by sliding contact therebetween.

Opposite sides 30 of the platform 22 illustratively have siderails 34 attached thereto. The siderails 34 are illustratively movable between a raised position shown in FIGS. 1–3 and a lowered position in a conventional manner. When the siderails 34 are in the raised position, the siderails 34, in combination with the headboard 14 and the footboard 16, define an enclosure above the platform 22 and mattress 12 where the patient resides. Placing the siderails 34 in the lowered position allows the patient to enter and exit the bed 10.

Further, when the patient is entering or exiting the bed, it is desirable to adjust the height of the support platform 22 of the bed 10 as close to the floor 36 as possible. Therefore, the platform 22 is coupled to the base 18 by a lifting mechanism 35 so that the platform 22 is movable relative to the base 18. The lifting mechanism 35 may comprise a conventional hi/lo device of the type well-known in the art.

The base 18 provides stability and supports the platform 22. The base 18 includes casters 37 which engage the floor 36. The base 18 is coupled to the platform 22 by a plurality of supports 38 of the lifting mechanism 35. The supports 38 preferably allow the alteration of the distance between the base 18 and the platform 22, thereby allowing adjustment of the height of platform 22. The illustrated embodiment of the bed 10 includes four supports 38 that include upper sections 39 and lower sections 40. Two of the supports 38 are positioned proximate each side 30 of the support platform 22. While only two of the supports 38 are illustrated, it should be noted that the supports 38 of the opposing sides 30 of the bed 10 are identical. The upper sections 39 are coupled to the lower sections 40 by pivot connections 42, and to the platform 22 by pivot connections 44 at the head end 24 and by fixed connections 45 at the foot end 26. The lower sections 40 are also coupled to the base 18 by pivot connections 46.

Figure 2:
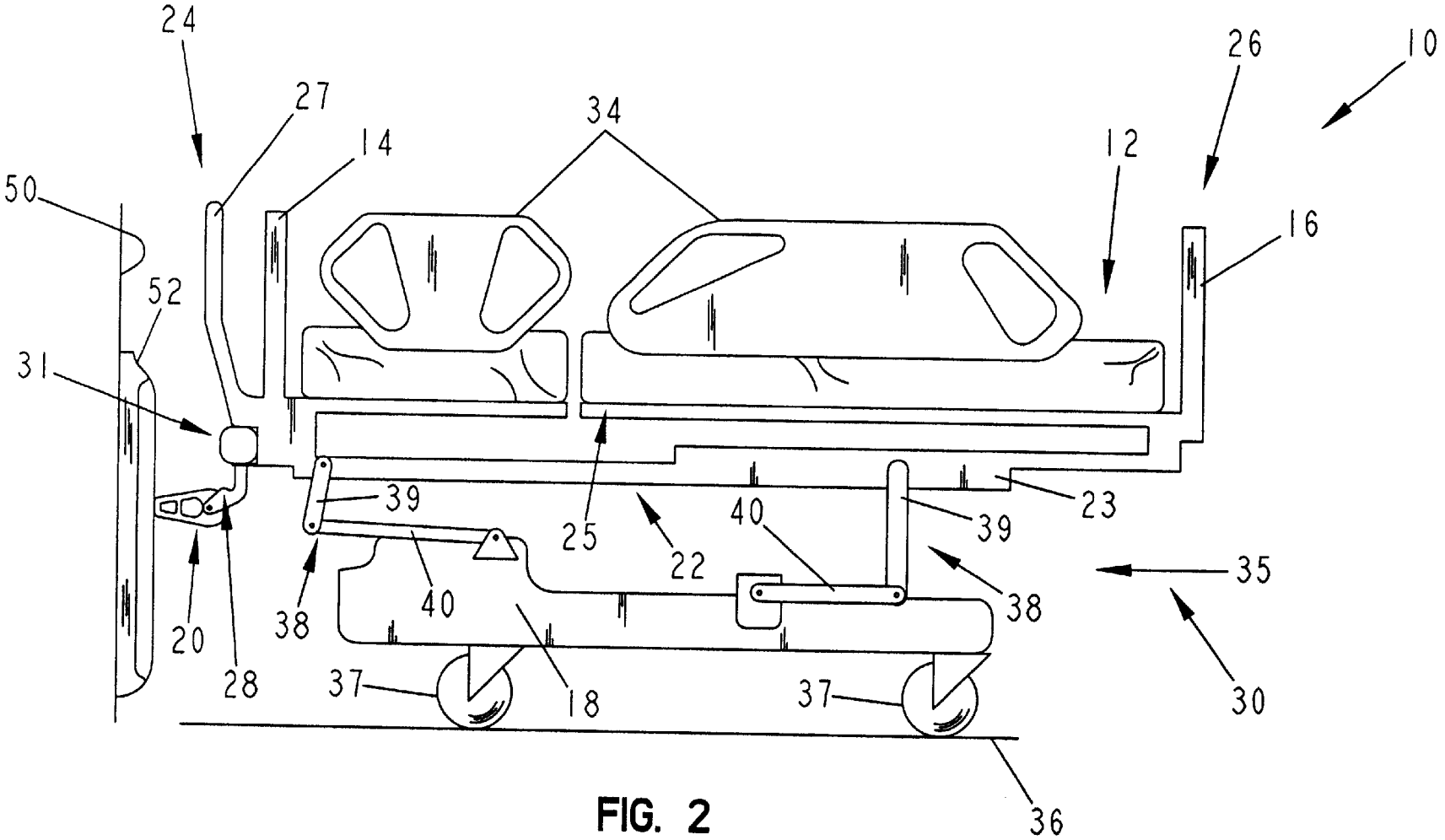
FIG. 2 is a side elevational view of the hospital bed of FIG. 1 illustrating the patient support platform of the bed in a middle or intermediate neutral position.
Figure 3:
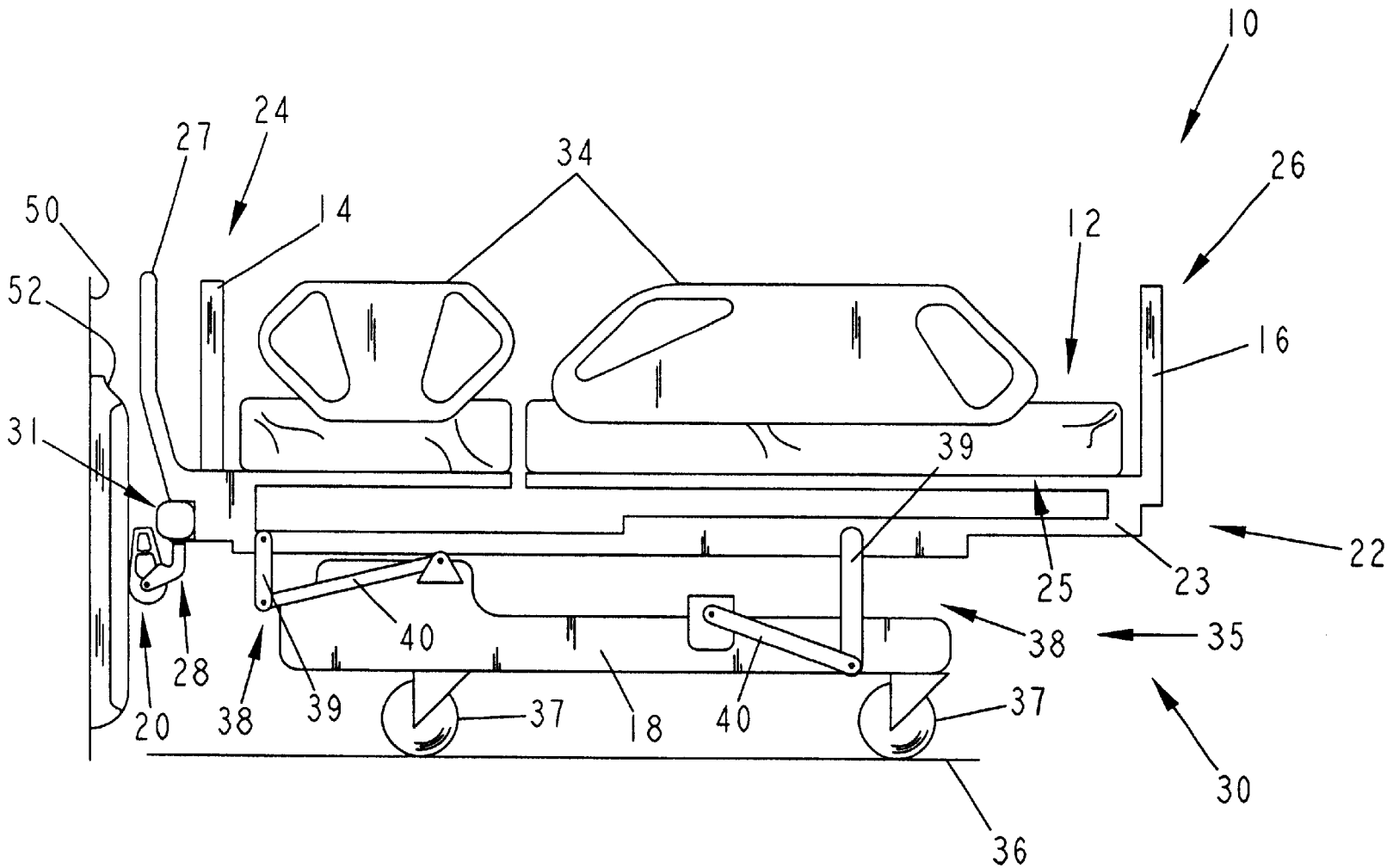
FIG. 3 is a side elevational view of the hospital bed of FIG. 1 illustrating the patient support platform of the bed in a lowered position.

A conventional actuator or motor (not shown) is used to adjust the lifting mechanism 35 and move the platform 22 from an elevated position shown in FIG. 1, through an intermediate neutral position shown in FIG. 2, and to a lowered position shown in FIG. 3. In certain models of beds 10, vertical movement of the support platform 22 by the hi/lo or lifting mechanism 35 is accompanied by horizontal movement of the platform 22. Such models include the Total Care™ bed, the Advanta™ bed, and the Advance™ bed manufactured by Hill-Rom, Inc. of Batesville, Ind. The elements of the hi/lo or lifting mechanism 35 combine to move the platform 22 along an arcuate path of travel. As shown in FIG. 4, the bumpers 20 also move along an arcuate path of travel 48 as the platform 22 is moved between the raised position of FIG. 1, the intermediate neutral position of FIG. 2, and the lowered position of FIG. 3.

Many hospital beds 10 have medical devices, electronic or otherwise, installed therein. Many of these devices require a power source to operate and, as such, the device and the bed 10 housing the device are typically placed near a power source, usually housed in a vertical wall 50. The wall 50 often also has outlets for gasses, vacuums, monitors, and call buttons that may be of use to the patient, need to be accessible to the patient, or need to be attached to the patient. Therefore, it is often convenient to locate the bed 10 near the outlets in the wall 50. The outlets are sometimes located in a head wall 50 adjacent to a bed locator 52. Bed locators 52 are well-known in the art and are physically attached to the wall 50. When the bed 10 is connected to the power, gas, vacuum or other conduit in the wall 50, there are typically plugs, wires, or tubes which extend from the wall 50.

Due to the arcuate path of travel of the patient support platform 22 and the desire of the caregiver to locate the bed 10 as close to the wall 50 as possible, some conventional beds 10 that move along the arcuate path of travel may undesirably engage the wall 50 or bed locator 52. Such engagement during movement along the arcuate path of travel may damage the wall 50, bed locator 52, or equipment mounted on the bed 10. The bumpers 20 of the present invention are designed to reduce the likelihood of damage to the wall 50, the bed locator 52, or equipment mounted on the bed 10.

Figure 5:
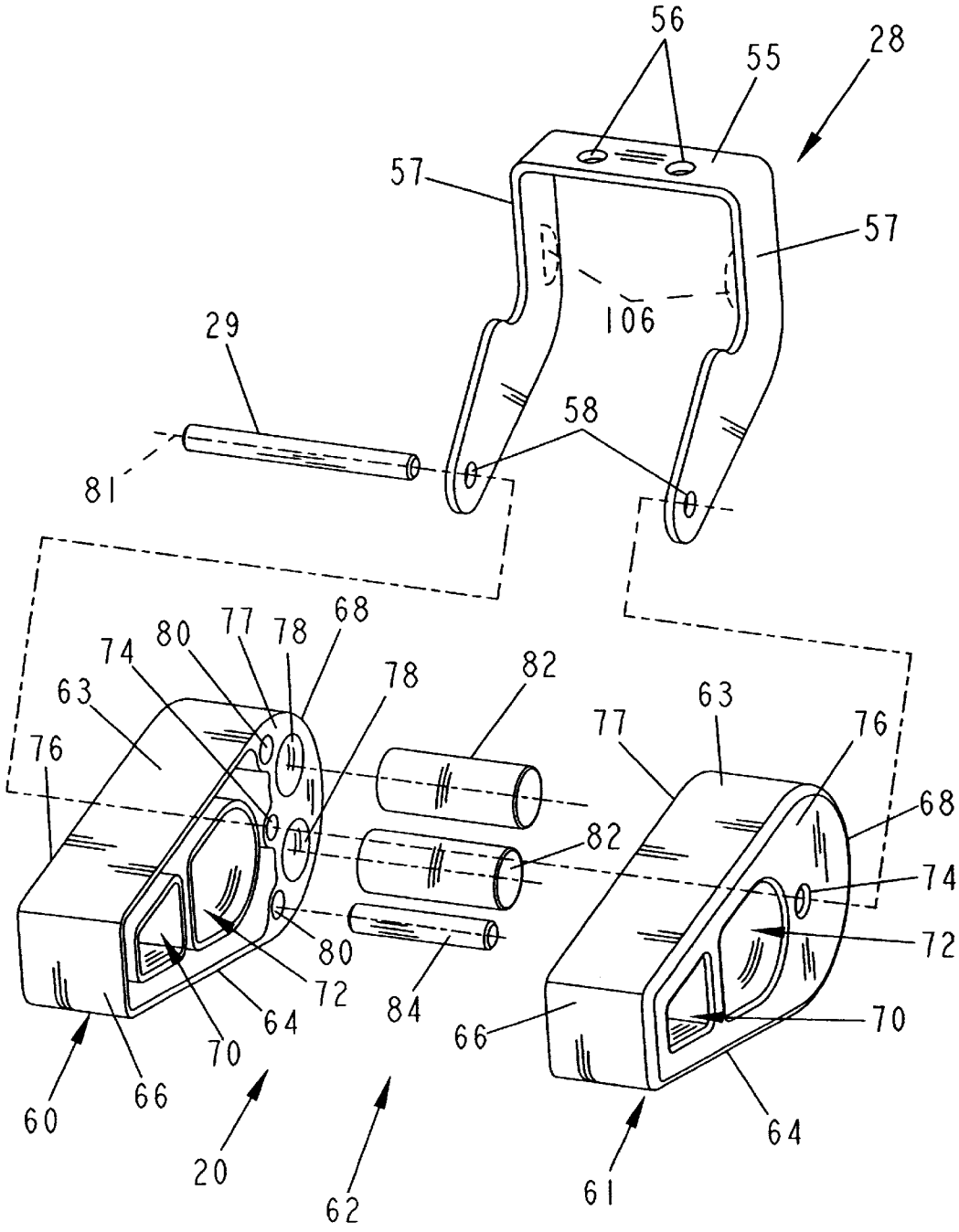
FIG. 5 is an exploded isometric view of the bumper apparatus of FIGS. 1–4.

As best shown in FIG. 5, each end bumper 20 is coupled to the frame 23 of support platform 22 by a mounting bracket 28. The mounting bracket 28 includes a top mounting surface 55 formed to include apertures 56 configured to receive fasteners (not shown) for coupling the mounting bracket 28 to the frame 23 of the bed 10. Any suitable fasteners may be used including bolts, screws, rivets, or the like. The mounting bracket 28 includes two downwardly extending arms 57 which are spaced apart to receive the bumper 20 therebetween. The arms 57 are formed to include apertures 58. The apertures 58 are configured to receive a horizontally extending axle 29 which pivotably couples the bumper 20 to the mounting bracket 28.

As illustrated in FIG. 5, each bumper 20 illustratively includes first and second body portions 60 and 61 which are coupled together to form a body 62 of the bumper 20. The body 62 has a generally ellipsoidal cross-sectional shape. Each of the first and second body portions 60 and 61 includes upper surface 63, a lower surface 64, a nose surface 66, and a back surface 68. Each body portion 60 and 61 also includes apertures 70, 72, and 74 which extend through the body sections 60 and 61 from an outer surface 76 to an inner surface 77. Each of the first and second body portions 60 and 61 includes internal bores 78 formed in inner surface 77. Each body portion 60 and 61 also includes smaller bores 80 formed in inner surface 77 above and below the central aperture 74.

The body portions 60 and 61 are illustratively made from a resilient material which holds its shape and returns to its shape if deformed. The resilient material illustratively allows the bumper 20 to be deformed slightly if enough force is applied. The resilient material may comprise an elastomeric or thermoplastic material, although similar materials may be readily substituted therefor. First and second body portions 60 and 61 are illustratively identically shaped pieces which have been rotated 180 degrees about a longitudinal axis. Therefore, a single mold can be used to make both the first and second body portions 60 and 61.

Referring further to FIG. 5, the apertures 74 receive the axle 29 defining a pivot axis 81 about which the body 62 of the bumper 20 may pivot. The body 62 of the bumper 20 is eccentrically mounted on the axle 29 such that the geometric center of the body 62 does not pass through the pivot axis 81. Instead, the geometric center of the body 62 is positioned intermediate the pivot axis 81 and the nose surface 66. Illustratively, two large cylindrical weights 82 are located within bores 78 of first and second body portions 60 and 61. A smaller weight 84 is located within the lower bore 80 of body portions 60 and 61. Weights 82 and 84 provide a counterbalance for the larger portion of the bumper 20 which extends toward the nose surface 66. More particularly, counterbalance weights 82 and 84 form a biasing device which balance the body 62 on the axle 29 so that the bumper 20 automatically moves to a generally horizontally extending, or balanced rest, position shown in FIGS. 2 and 7 where the body 62 of the bumper 20 is free floating on the axle 59. Once the weights 82 and 84 are inserted, the body portions 60 and 61 are coupled together to form the bumper 20. It is understood that the bumper 20 can be formed as a single piece with the body 62 being formed, for example by molding, over the weights 82 and 84, if desired.

Figure 8:
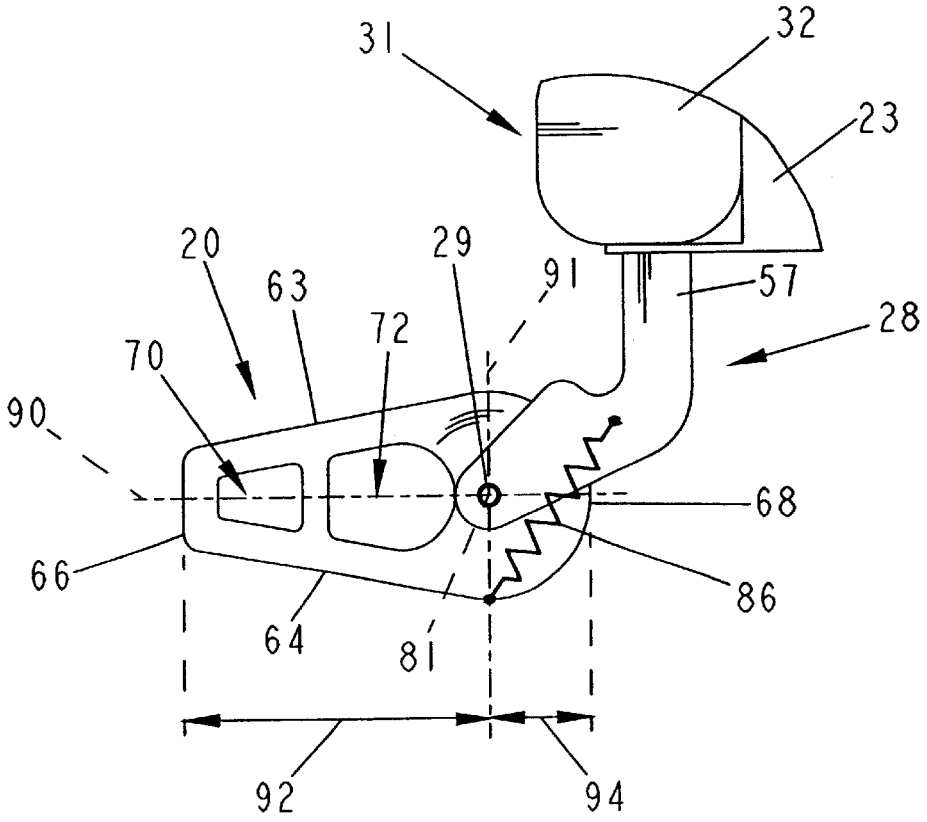
FIG. 8 is a side elevational view similar to FIG. 6 of an alternative embodiment of the bumper apparatus.

It is understood that other biasing mechanisms may be used in place of counterweights 82 and 84 in other embodiments of the present invention. For instance, as illustrated in FIG. 8, conventional elastic members, such as springs 86 or resilient memory material, may be used to bias elongated bumper 20' so that the body 62 of the bumper 20' is in its balanced rest position, generally horizontally relative to the frame 23 of the bed 10. Such elongated bumper 20' is pivotably coupled to a mounting bracket 88 to pivot in a manner similar to bumper 20 in FIG. 4 as the platform 22 moves up and down. The biasing mechanism 86 returns the elongated bumper 20' to the normally horizontal or balanced rest position when the bumper 20' moves away from the wall 50.

Figure 6:
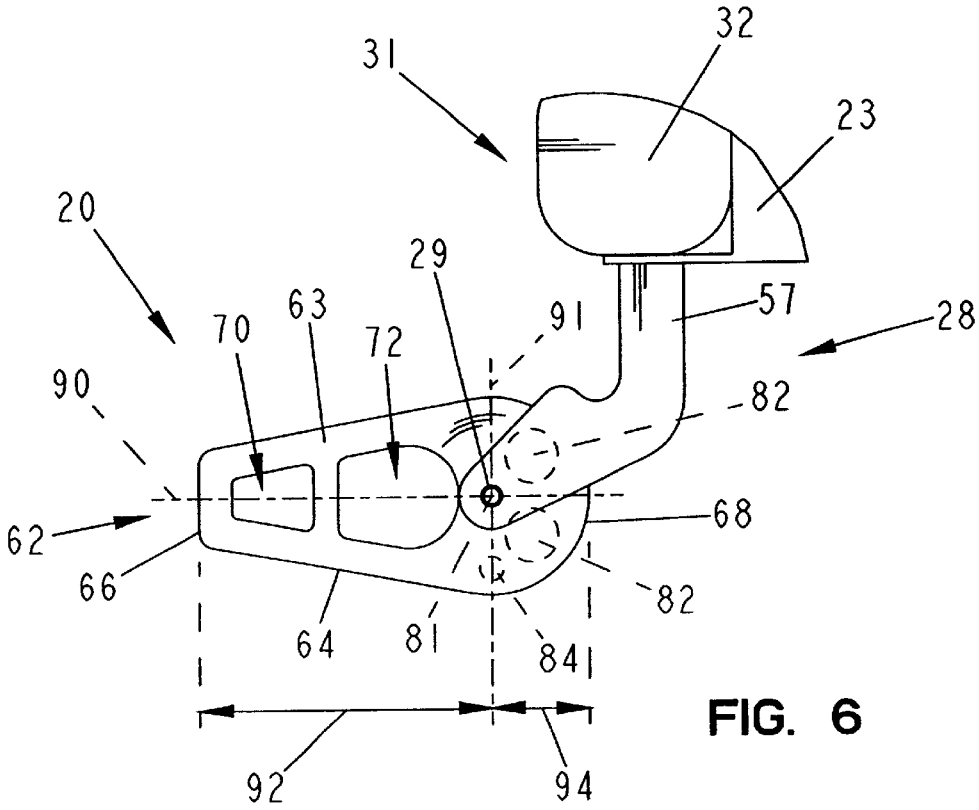
FIG. 6 is a side elevational view of the bumper apparatus of FIG. 5 in a balanced rest position.

As best shown in FIG. 6, the bumper 20 includes a major horizontal or longitudinal axis 90 and a minor vertical or transverse axis 91, both extending through the pivot axis 81 of the axle 29. A distance from the nose surface 66 to the pivot axis 81 of axle 29 is illustrated by dimension 92. A distance from the pivot axis 81 of axle 29 to back surface 68 is illustrated by dimension 94. The pivot axis 81 is located closer to the back surface 68 than to the nose surface 66 such that the dimension 92 is greater than the dimension 94. In the illustrated embodiment, bumpers 20 are configured so that the difference between the distance 92 and the distance 94 is greater than or equal to the horizontal displacement of the platform 22 as the platform 22 moves from its raised position shown in FIG. 1 to its lower intermediate neutral position shown in FIG. 2 and likewise is greater than or equal to the horizontal displacement as the platform 22 moves from the intermediate neutral position of FIG. 2 to the lowered position of FIG. 3. Therefore, if the bed 10 is situated so that the nose surface 66 of bumpers 20 engage a wall 50 or other surface, the platform 22 can be moved between its low position and its high position without engaging the wall 50 or other attached structure.

Details of such movement of the bumper 20 are illustrated in FIG. 4. Assuming that the bed 10 is moved toward the wall 50 or other surface in the hospital room when the patient platform 22 is in the intermediate position shown in FIG. 2, the nose surface 66 engages the bed locator 52 to prevent the bed 10 from being moved further toward the bed locator 52 as shown in location 96 in FIG. 4. The flat nose surface 66 reduces the likelihood that the bumper 20 will pivot on axle 59 as the bed is pushed straight toward the wall 50.

As detailed above, the nose surface 66 initially engages the wall 13 or bed locator 52 as illustrated in FIG. 2, which corresponds to the arrangement labeled '96' in FIG. 4. In this position the bed 10 is located a first distance perpendicular from the wall 50. As the patient support platform 22 is moved to its elevated position shown in FIG. 1 by the lifting mechanism 35, the bumper 20 pivots in a first or counterclockwise direction about axle 59, as indicated by arrow 99 in FIG. 4, in response to the friction between the bumper 20 and the locator 52 to the position shown in location 98. At this elevated position, the upper surface 63 of the bumper 20 is engaging the locator 52, and the bed 10 is located a second distance perpendicular from the wall 50. As illustrated, the second distance is less than the first distance and the differential therebetween is greater than or equal to the horizontal displacement of the platform 22 as detailed above. As the patient support platform 22 is moved by the lifting mechanism 35 to its lowered position shown in FIG. 3, the bumper 20 pivots in a second or clockwise direction, as indicated by arrow 101, relative to the mounting bracket 28. Moreover, the bumper 20 moves to the position illustrated at location 100 in FIG. 4 in response to the friction between the bumper 20 and the locator 52. At this lowered position, the lower surface 64 of the bumper 20 is engaging the locator 52, and the bed 10 is located a third distance perpendicular from the wall 50. In the illustrated embodiment, the third distance is substantially the same as the second distance. It should be appreciated, however, that the third and second distances may differ depending upon the motion of the support platform 22. Therefore, the bumpers 20 provide horizontal spacing to prevent the patient support platform 22 from engaging the bed locator 52 or the wall 50. The bumper 20 also rotates further in the event that the bumper 20 engages plugs in the wall or other obstructions.

FIG. 4 shows the travel and rotation of the bumpers 20 when the axles 29 are located at an apex 102 of the arcuate path 48 when the bumpers 20 first engage the locator 52 or wall 50. However, it should be appreciated that the bumpers 20 will properly position the bed 10 and protect the wall 50 if the bumpers 20 contact the wall 50 when the platform 22 of bed 10 is positioned such that the axle 29 is not in the apex 102 position. In this situation, if the bumpers 20 are first moved along the arcuate path 48 closer to the wall 50, the bumpers 20 will rotate about the axle 29. However, if bumpers 20 are first moved along the arcuate path 48 away from the wall 50, the nose surfaces 66 of bumpers 20 will lose contact with the wall 50 and the bumpers 20 will stay in the balanced rest position generally illustrated in FIG. 6 where the longitudinal axis 90 extends substantially horizontal. If the platform 22 continues moving so as to move the bumpers 20 along the acuate path 48 back towards the wall 50, the nose surfaces 66 of bumpers 20 will regain contact with the wall 50 and will then rotate as the distance between the platform 22 and the wall 50 continues to decrease.

Figure 7:
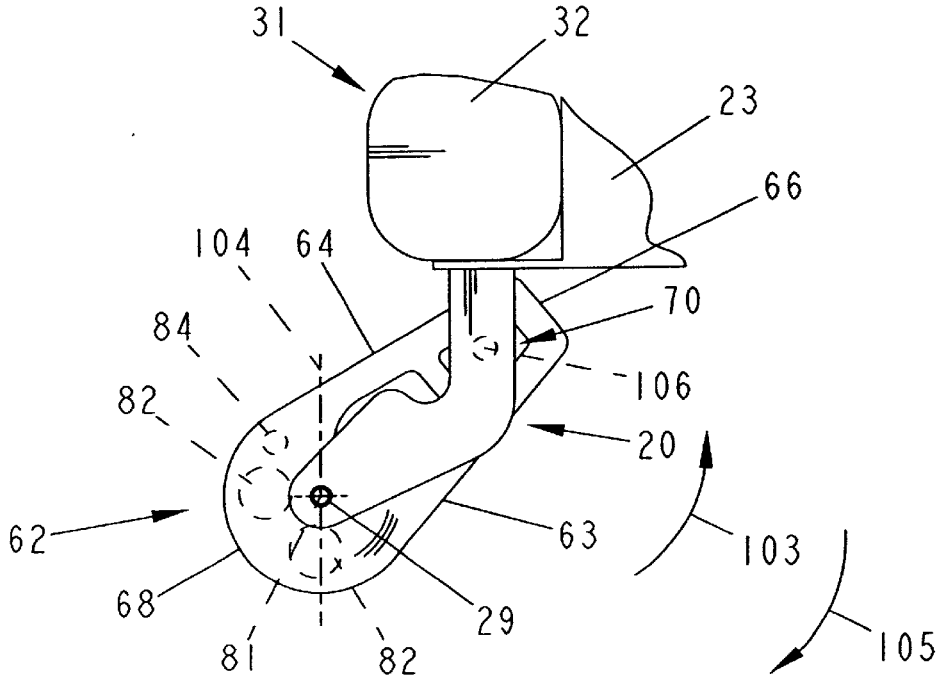
FIG. 7 is a side elevational view of the bumper apparatus of FIG. 5 in a storage position.

When it is desired to transport the patient, the bumpers 20 can be moved to a storage position shown in FIG. 7. This reduces the overall length of bed 10 so that the bed 10 can fit in tight quarters, such as in an elevator. Once the bumper 20 is pivoted in the direction of arrow 103 so that weights 82 and 84 pass over the center of a vertical axis 104, the weights 82 and 84 hold the bumper 20 in the storage position shown in FIG. 7. Bumpers 20 are moved in the direction of arrow 105 to return the bumpers 20 to the horizontal balanced position shown in FIG. 6. It should be appreciated that mechanical locking devices may also be utilized to lock the bumper 20 in the storage position of FIG. 7. Moreover, the width of the bumper 20 may be dimensioned so that the bumper 20 frictionally engages the bracket arms 57. Alternatively, the arms 57 may support inwardly extending protuberances 106 (shown in phantom in FIGS. 5 and 7) which are releasably received within apertures 70 of the bumper 20.

Figure 9:
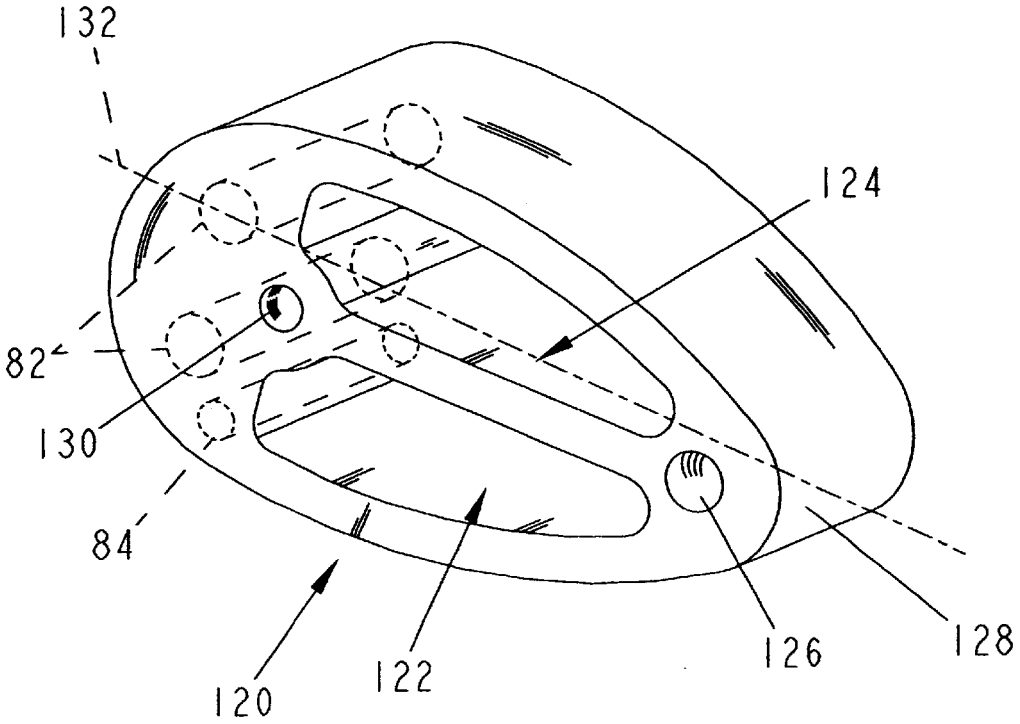
FIG. 9 is an isometric view of an alternative embodiment of the bumper apparatus of FIGS. 1–5.
Figure 10:
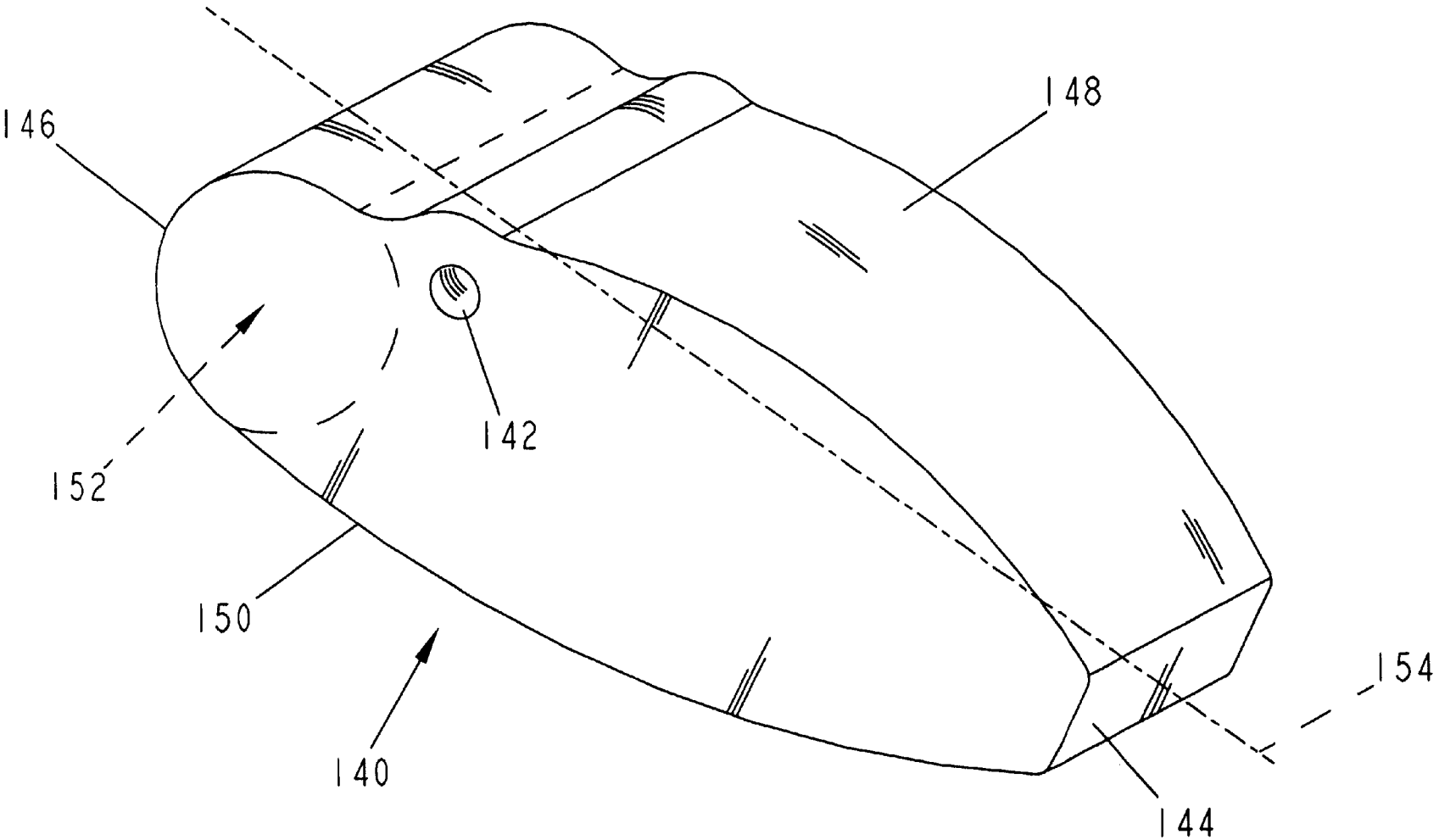
FIG. 10 is an isometric view of another alternative embodiment of the bumper apparatus of FIGS. 1–5.

FIGS. 9 and 10 show alternative embodiments for the bumper apparatus. In FIG. 9 bumper 120 is formed to include two large apertures 122 and 124 and a smaller aperture 126 located adjacent to nose surface 128. Bumper 120 further includes an aperture 130 for receiving axle 59. Bumper 120 includes internal weights 82 and 84 similar to those discussed above so the bumper 120 is balanced to rest along a horizontally aligned longitudinal axis 132.

Yet another alternative bumper design is illustrated in FIG. 10. The bumper 140 includes an aperture 142 for receiving the axle 59. Bumper 140 includes a nose surface 144, a back surface 146, an upper surface 148 and a lower surface 150. A counterbalance weight 152 is located adjacent back surface 146 so that the bumper 140 is balanced about its longitudinal axis 154 when the bumper 140 is attached to the mounting bracket 54.

Although the invention has been described in detail with reference to a certain illustrated embodiment, variations and modifications exist within the scope and spirit of the present invention as described and defined in the following claims.

What is claimed is:

1. A bumper apparatus for a bed, the bumper apparatus comprising:

an elongated body pivotably coupled to the bed; and a biasing mechanism coupled to the elongated body, the biasing mechanism being configured to continuously urge alignment of a longitudinal axis of the elongated body to a generally horizontal position extending away from the bed.

2. The apparatus of claim 1, wherein the biasing mechanism comprises at least one elastic member coupled to the body.

3. The apparatus of claim 2, wherein the at least one elastic member comprises a spring.

4. The apparatus of claim 1, wherein the body comprises a resilient material.

5. The apparatus of claim 1, wherein the body is formed from two identically shaped body members coupled together.

6. The apparatus of claim 1, wherein the body is formed to include a plurality of apertures therein.

7. A bumper apparatus for a bed, the bumper apparatus comprising:

an elongated body pivotably coupled to the bed; and a biasing mechanism coupled to the elongated body, the biasing mechanism being configured to align a longitudinal axis of the elongated body in a generally horizontal position extending away from the bed, the bed including a base, a support platform configured to support a patient, and a lifting mechanism configured to move the support platform vertically relative to the base between an elevated position and a lowered position, the support platform also moving horizontally relative to the base by a predetermined horizontal distance as the platform moves between the elevated position and the lowered position, the body being pivotably coupled to the support platform.

8. The apparatus of claim 7, wherein the body includes a nose surface configured to engage a wall, the body being configured to pivot in a first direction relative to the bed when the body is engaged with the wall and when a support platform of the bed is moved to the elevated position and to pivot in a second direction relative to the bed when the body is engaged with the wall and when a support platform of the bed is moved to the lowered position.

9. The apparatus of claim 7, wherein the body includes a nose surface configured to engage a wall and an opposite back surface, the body being pivotably coupled to the support platform about a pivot axis which is located between the nose surface and the back surface, and wherein a distance from the nose surface to the pivot axis minus a distance from pivot axis to back surface is at least as great as the predetermined horizontal distance.

10. A bumper apparatus for a bed, the bumper apparatus comprising:

an elongated body pivotably coupled to the bed; and a biasing mechanism coupled to the elongated body, the biasing mechanism being configured to align a longitudinal axis of the elongated body in a generally horizontal position extending away from the bed, the body including a generally flat nose surface configured to engage a wall.

11. A bumper apparatus for a bed, the bumper apparatus comprising:

an elongated body pivotably coupled to the bed; and a biasing mechanism coupled to the elongated body, the biasing mechanism being configured to align a longitudinal axis of the elongated body in a generally horizontal position extending away from the bed, the biasing mechanism comprising at least one counterweight coupled to the body.

12. The apparatus of claim 11, wherein the at least one counterweight is located inside the body.

13. The apparatus of claim 11, wherein the body includes a pivot axis that passes through the longitudinal axis and a secondary axis that passes through the pivot axis and is generally vertical when the longitudinal axis is generally horizontal.

14. The apparatus of claim 13, wherein the secondary axis intersects the body to define two sides of substantially equal mass.

15. The apparatus of claim 11, wherein the body is pivotably coupled to the bed about a pivot axis, and further comprising a second bumper coupled to the bed, the second bumper being rotatable about a rotation axis which is transverse to the pivot axis of the body.

16. The apparatus of claim 11, wherein the body is formed to include a plurality of apertures therein.

17. A bumper apparatus for a bed, the bumper apparatus comprising:

an elongated body pivotably coupled to the bed, the body being pivotably coupled to the bed about a pivot axis;

a biasing mechanism coupled to the elongated body, the biasing mechanism being configured to align a longitudinal axis of the elongated body in a generally horizontal position extending away from the bed; and a second bumper coupled to the bed, the second bumper being rotatable about a rotation axis which is transverse to the pivot axis of the body.

18. The apparatus of claim 11, wherein the pivot axis of the body is generally horizontal and the rotation axis of the second bumper is generally vertical.

19. A bumper apparatus for a bed, the bumper apparatus comprising:

an elongated body pivotably coupled to the bed, the body having a generally ellipsoidal cross sectional shape; and a biasing mechanism coupled to the elongated body, the biasing mechanism being configured to align a longitudinal axis of the elongated body in a generally horizontal position extending away from the bed.

20. A bumper apparatus for a bed, the bumper apparatus comprising:

an elongated body pivotably coupled to the bed, the body including a nose surface configured to engage a wall and an opposite back surface, the body being pivotably coupled to the bed about a pivot axis which is located closer to the back surface than the nose surface; and a biasing mechanism coupled to the elongated body, the biasing mechanism being configured to align a longitudinal axis of the elongated body in a generally horizontal position extending away from the bed.

21. A bumper apparatus for a patient support, the bumper apparatus comprising:

a body including a longitudinal axis and a nose surface configured to engage a wall;

the patient support including a base, a support platform configured to support a patient, and a lifting mechanism configured to move the support platform vertically relative to the base between a first position and a second position below the first position, the support platform also configured to move horizontally relative to the base by a predetermined horizontal distance as the platform moves between the first position and the second position; and the body pivotably coupled to the support platform about an eccentrically positioned pivot axis, the body configured to pivot in a first direction relative to the patient support when the body is engaged with the wall and when the support platform is moved upwardly to the first position, and configured to pivot in a second direction relative to the patient support when the body is engaged with the wall and when the support platform is moved downwardly to the second position.

22. The apparatus of claim 21, wherein the nose surface is substantially flat.

23. The apparatus of claim 21, further comprising a biasing mechanism coupled to the body, the biasing mechanism configured to align the longitudinal axis of the body in a generally horizontal position away from the patient support.

24. The apparatus of claim 23, wherein the biasing mechanism comprises at least one counterweight coupled to the body.

25. The apparatus of claim 21, further comprising a side bumper coupled to the bed, the side bumper being rotatable about a rotation axis which is transverse to the pivot axis of the body.

26. The apparatus of claim 25, wherein the pivot axis of the body is generally horizontal and the rotation axis of the second bumper is generally vertical.

27. The apparatus of claim 21, wherein the body has a generally ellipsoidal cross sectional shape.

28. The apparatus of claim 21, wherein the body includes a back surface opposite the nose surface, the pivot axis of the body located closer to the back surface than the nose surface.

29. A bumper apparatus for a patient support, the bumper apparatus comprising:

a body pivotably coupled to the patient support and including a longitudinal axis and a nose surface, the body configured to move between first and second positions, the nose surface engaging a vertically extending wall when the body is in the first position; and a biasing mechanism coupled to the body, the biasing mechanism configured to align the body in the first position.

30. The apparatus of claim 29, wherein the biasing mechanism is configured to align the longitudinal axis of the body in a generally horizontal position extending away from the patient support.

31. The apparatus of claim 29, wherein the patient support includes a base, a support platform configured to support a patient, and a lifting mechanism configured to move the support platform vertically relative to the base between an elevated position and a lowered position, the support platform also moving horizontally relative to the base by a predetermined horizontal distance as the platform moves between the elevated position and the lowered position, the body being pivotably coupled to the support platform.

32. The apparatus of claim 31, wherein the body is pivotably coupled to the support platform about a pivot axis which is located between the nose surface and the back surface, and wherein a distance from the nose surface to the pivot axis minus a distance from pivot axis to back surface is at least as great as the predetermined horizontal distance.

33. The apparatus of claim 29, wherein the biasing mechanism comprises at least one counterweight coupled to the body.

34. The apparatus of claim 27, wherein the body is pivotably coupled to the patient support about a pivot axis, and further comprising a second bumper coupled to the patient support, the second bumper being rotatable about a rotation axis which is transverse to the pivot axis of the body.

35. The apparatus of claim 34, wherein the pivot axis of the body is generally horizontal and the rotation axis of the second bumper is generally vertical.

36. The apparatus of claim 24, wherein the body has a generally ellipsoidal cross sectional shape.

37. The apparatus of claim 29, wherein the body includes a back surface opposite the nose surface, the body pivotably coupled to the patient support about a pivot axis which is located closer to the back surface than the nose surface.

38. The apparatus of claim 37, wherein the body further includes opposing upper and lower surfaces connecting the nose surface and the back surface, one of the upper and lower surfaces engaging the vertically extending wall when the body is in the second position.

39. A bumper apparatus comprising:

a horizontal spacing means coupled to a patient support and including a contact surface for movement between first and second positions relative to a vertical wall, the patient support positioned a first distance perpendicular from the wall when the contact surface is in the first position, and the patient support positioned a second distance perpendicular from the wall when the contact surface is in the second position; and a biasing means coupled to the horizontal spacing means, the biasing means biasing the contact surface toward the first position.

40. The bumper apparatus of claim 39, wherein the patient support includes a base, a support platform configured to support a patient, and a lifting mechanism configured to move the support platform vertically relative to the base between a first position and a second position below the first position, the support platform also moving horizontally relative to the base by a predetermined horizontal distance as the platform moves between the first position and the second position, the horizontal spacing means including a body pivotably coupled to the support platform.

41. The apparatus of claim 40, wherein the contact surface moves between said first and second positions as the support platform moves the predetermined horizontal distance.

42. The apparatus of claim 40, wherein the body is configured to pivot in a first direction relative to the patient support when the body is engaged with the wall and when the support platform is moved upwardly to the first position and is configured to pivot in a second direction relative to the patient support when the body is engaged with the wall and when the support platform is moved downwardly to the second position.

43. The apparatus of claim 39, wherein the biasing means comprises at least one counterweight coupled to the horizontal spacing means.

44. The apparatus of claim 39, wherein the horizontal spacing means includes a body pivotably coupled to the patient support about a pivot axis, and further comprising a second bumper coupled to the patient support, the second bumper being rotatable about a rotation axis which is transverse to the pivot axis of the body.

45. The apparatus of claim 44, wherein the pivot axis of the body is generally horizontal and the rotation axis of the second bumper is generally vertical.

46. A bumper apparatus for a bed, the bumper apparatus comprising:

an elongated body pivotably coupled to the bed; and a biasing mechanism coupled to the elongated body, the biasing mechanism being configured to align a longitudinal axis of the elongated body in a generally horizontal position extending away from the bed, the body having a range of possible movement, the biasing mechanism biasing the body at all positions within the range of possible movement.

47. The apparatus of claim 46, wherein the bed includes a base, a support platform configured to support a patient, and a lifting mechanism configured to move the support platform vertically relative to the base between an elevated position and a lowered position, the support platform also moving horizontally relative to the base by a predetermined horizontal distance as the platform moves between the elevated position and the lowered position, the body being pivotably coupled to the support platform.

48. The apparatus of claim 47, wherein the body includes a nose surface configured to engage a wall, the body being configured to pivot in a first direction relative to the bed when the body is engaged with the wall and when a support platform of the bed is moved to the elevated position and to pivot in a second direction relative to the bed when the body is engaged with the wall and when a support platform of the bed is moved to the lowered position.

49. The apparatus of claim 47, wherein the body includes a nose surface configured to engage a wall and an opposite back surface, the body being pivotably coupled to the support platform about a pivot axis which is located between the nose surface and the back surface, and wherein a distance from the nose surface to the pivot axis minus a distance from pivot axis to back surface is at least as great as the predetermined horizontal distance.

50. The apparatus of claim 46, wherein the body includes a generally flat nose surface configured to engage a wall.

51. The apparatus of claim 46, wherein the biasing mechanism comprises at least one counterweight coupled to the body.

52. The apparatus of claim 51, wherein the at least one counterweight is located inside the body.

53. The apparatus of claim 46, wherein the biasing mechanism comprises at least elastic member coupled to the body.

54. The apparatus of claim 53, wherein the at least one elastic member comprises a spring.

55. The apparatus of claim 46, wherein the body comprises a resilient material.

56. The apparatus of claim 46, wherein the body is pivotably coupled to the bed about a pivot axis, and further comprising a second bumper coupled to the bed, the second bumper being rotatable about a rotation axis which is transverse to the pivot axis of the body.

57. The apparatus of claim 56, wherein the pivot axis of the body is generally horizontal and rotation axis of the second bumper is generally vertical.

58. The apparatus of claim 46, wherein the body is formed from two identically shaped body members coupled together.

59. The apparatus of claim 46, wherein the body is formed to include a plurality of apertures therein.

60. The apparatus of claim 46, wherein the body has a generally ellipsoidal cross sectional shape.

61. The apparatus of claim 46, wherein the body includes a nose surface configured to engage a wall and an opposite back surface, the body being pivotably coupled to the bed about a pivot axis which is located closer to the back surface than the nose surface.

* * * * *